US009920525B1

(12) United States Patent
Underkofler et al.

(10) Patent No.: US 9,920,525 B1
(45) Date of Patent: Mar. 20, 2018

(54) ACOUSTICAL BAFFLE PANEL SYSTEM

(71) Applicant: USG Interiors, LLC, Chicago, IL (US)

(72) Inventors: Abraham M. Underkofler, Salem, WI (US); Peder J. Gulbrandsen, Aurora, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 15/485,478

(22) Filed: Apr. 12, 2017

(51) Int. Cl.

| | |
|---|---|
| ***E04B 9/36*** | (2006.01) |
| ***E04B 1/99*** | (2006.01) |
| ***E04B 9/18*** | (2006.01) |
| ***E04B 9/10*** | (2006.01) |
| ***E04B 1/82*** | (2006.01) |
| ***E04B 1/84*** | (2006.01) |
| ***E04B 1/86*** | (2006.01) |

(52) U.S. Cl.
CPC ..... *E04B 9/363* (2013.01); *E04B 1/8209* (2013.01); *E04B 1/8409* (2013.01); *E04B 1/86* (2013.01); *E04B 1/99* (2013.01); *E04B 9/10* (2013.01); *E04B 9/18* (2013.01); *E04B 2001/8263* (2013.01)

(58) Field of Classification Search
CPC ..... E04B 9/363; E04B 1/86; E04B 1/8409; E04B 1/99; E04B 9/10; E04B 9/18; E04B 1/8209; E04B 2001/8263; E04B 1/994; E04B 2001/8272
See application file for complete search history.

(56) References Cited

U.S. PATENT DOCUMENTS 3,211,403 A * 10/1965 Havener ..... E04B 9/18 248/62
3,358,411 A * 12/1967 Birum, Jr. ..... E04B 2/825 52/204.599
3,436,047 A * 4/1969 Foltz ..... A47H 1/104 104/111
3,596,425 A * 8/1971 Kodaras ..... E04B 9/008 403/201
3,784,144 A * 1/1974 Ollinger ..... E04B 9/18 248/317
4,031,664 A * 6/1977 Wendt ..... E04B 1/6116 248/300
4,081,931 A * 4/1978 Miyoshi ..... E04B 9/366 52/39
4,197,923 A * 4/1980 Harris ..... E04B 1/86 181/287
4,200,171 A * 4/1980 Seymour ..... E04B 1/86 16/87 R
4,227,355 A * 10/1980 Wendt ..... E04B 1/86 160/196.1
4,544,119 A * 10/1985 Kellett ..... E04B 9/18 24/295

(Continued)

FOREIGN PATENT DOCUMENTS

DE 102014001543 A1 * 9/2015 ..... E04B 9/10
GB 2531482 A * 4/2016 ..... E04B 1/8409

*Primary Examiner* — Rodney Mintz
(74) *Attorney, Agent, or Firm* — Pearne & Gordon LLP

(57) ABSTRACT

An acoustical baffle assembly comprising an elongated rigid upper carrier, a rigid panel supported on the carrier and a plurality of clips attaching the panel on the carrier at a plurality of locations along the length of the carrier, the clips each being clinched on an upper edge of the panel and being engaged with the carrier.

6 Claims, 4 Drawing Sheets

(56) References Cited

U.S. PATENT DOCUMENTS

| | | | | | |
|---|---|---|---|---|---|
| 4,703,598 | A * | 11/1987 | Wilson | E04B 2/7409 | 52/204.591 |
| 5,577,699 | A * | 11/1996 | Gardner | A47F 5/0006 | 248/217.2 |
| 5,768,843 | A * | 6/1998 | Dziedzic | E04B 9/18 | 248/228.7 |
| 5,806,823 | A * | 9/1998 | Callas | G09F 15/025 | 248/317 |
| 8,336,843 | B2 * | 12/2012 | Gulbrandsen | E04B 9/065 | 24/536 |
| 8,397,408 | B2 * | 3/2013 | Stancer, III | G09F 1/103 | 40/607.14 |
| 8,695,296 | B2 * | 4/2014 | Bergman | E04B 9/366 | 248/343 |
| 8,713,869 | B1 * | 5/2014 | Eychaner | H05K 7/20745 | 52/238.1 |
| 9,771,718 | B1 * | 9/2017 | Curtin | E04B 9/12 | |
| 2005/0226683 | A1 * | 10/2005 | Herb | E04B 9/127 | 403/230 |
| 2010/0205841 | A1 * | 8/2010 | Stancer, III | G09F 1/103 | 40/607.14 |
| 2011/0011023 | A1 * | 1/2011 | Gulbrandsen | E04B 9/065 | 52/506.07 |
| 2012/0291397 | A1 * | 11/2012 | Bergman | E04B 9/366 | 52/745.21 |
| 2013/0047541 | A1 * | 2/2013 | Mayer | E04B 9/366 | 52/506.05 |
| 2013/0205702 | A1 * | 8/2013 | D'Alessandro | E04B 9/183 | 52/506.08 |

* cited by examiner

FIG. 1
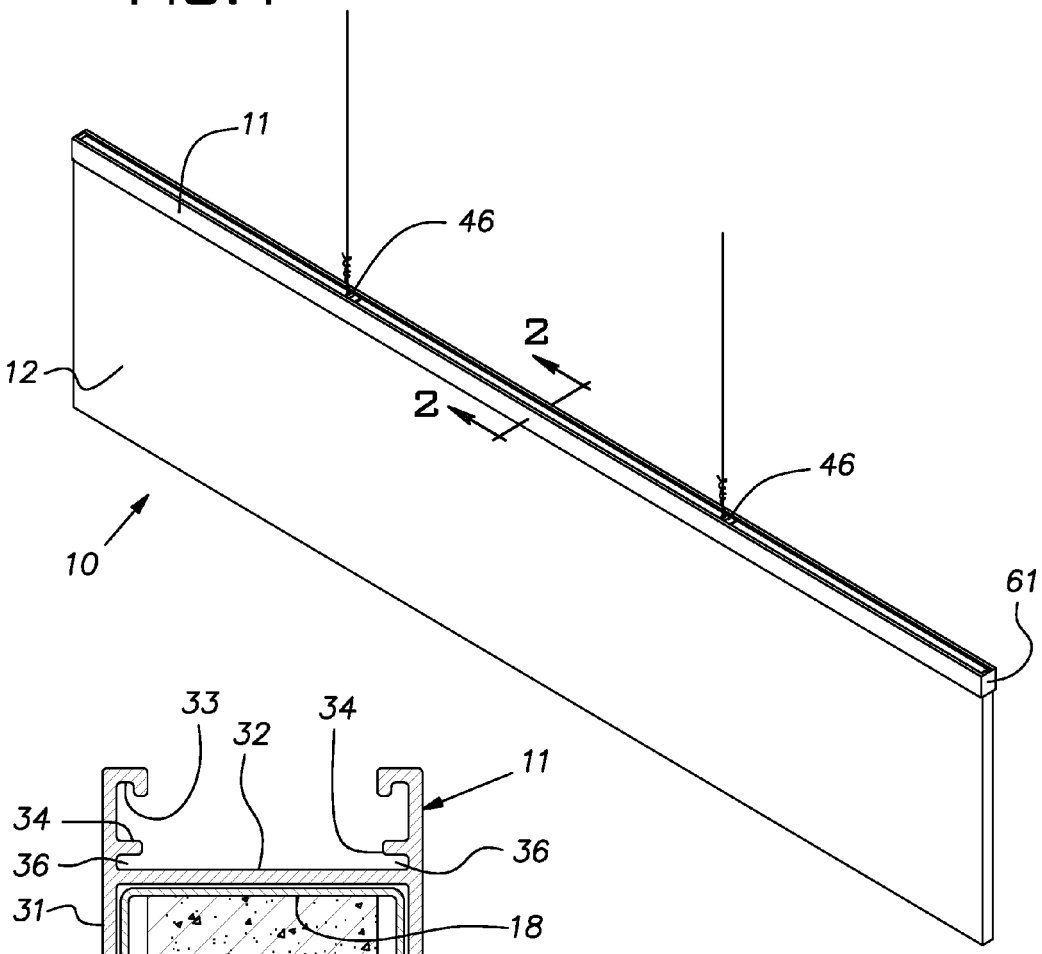
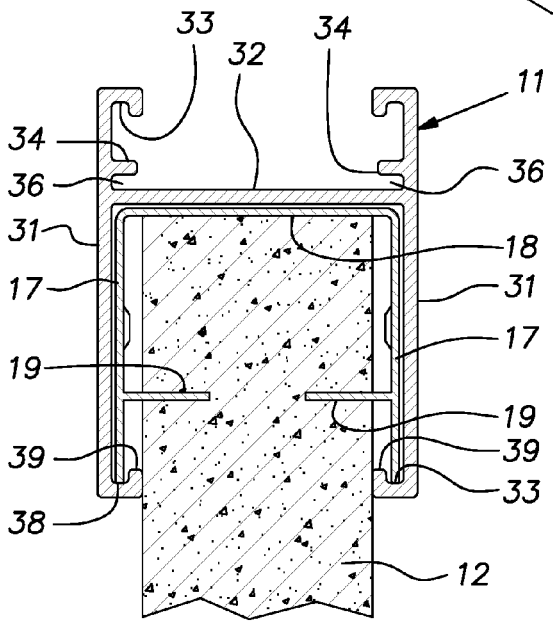
FIG. 2

FIG. 10
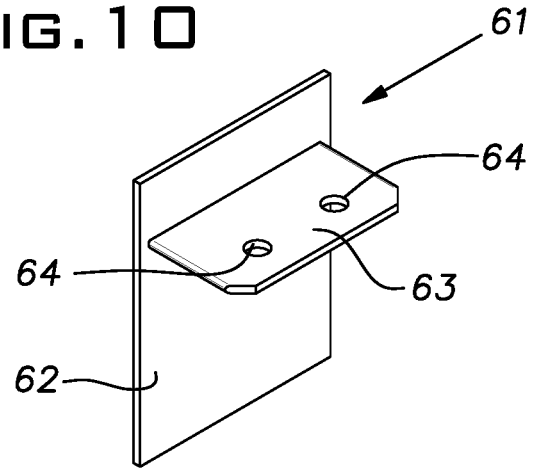
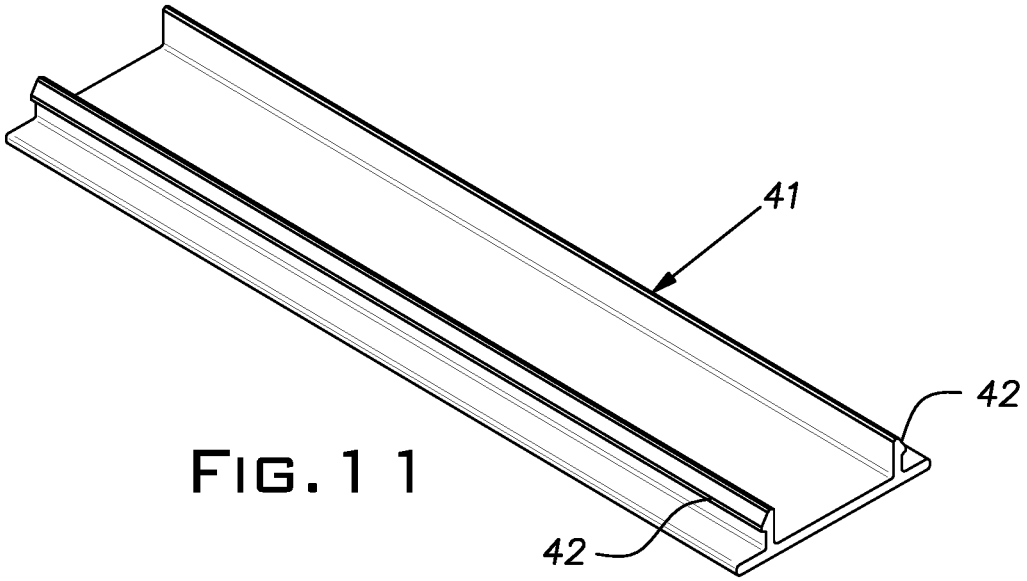
FIG. 11

ACOUSTICAL BAFFLE PANEL SYSTEM

BACKGROUND OF THE INVENTION

The invention relates to sound control in open plenum structures.

PRIOR ART

Commercial and public buildings without acoustical ceilings can require sound absorption techniques to limit the loudness of sound and control reverberation in an enclosed space. Without proper acoustics, sound generated at an enclosed space may, for example, be harmful to health, interfere with human speech, and detract from musical or audio performances.

It is known to suspend sound absorbing baffles in high ceiling or open plenum spaces to control sound. Such prior art baffles have often emphasized function without full regard to the aesthetics or formal nature of an installation.

SUMMARY OF THE INVENTION

The invention provides an acoustical baffle panel system that affords a custom formal appearance, dimensional and geometrical versatility, and ease of assembly and installation. The system includes a rigid header bar that supports an underlying vertically oriented panel or panels. The header bar enables the baffle system to be adequately suspended at any convenient point along its length without perceptible deflection in the assembly intermediate the suspension points or cantilevered outward of the suspension points.

The disclosed header bar is an aluminum extrusion having an H-shaped cross-section including a horizontal web between opposed vertical legs. Sheet metal retention clips are bent to clasp upper edges of an acoustical panel. The retention clips, after assembly on the panel, are configured to slide endwise with the panel into a lower part of the header bar. The clips and upper panel edge are concealed and supported within the header bar by inturned flanges on lower edges of the opposed legs.

Hanger clips are assembled in an upper portion of the header bar and can be positioned at any desired or convenient location along the header bar for receiving overlying suspension wire or cable. The hanger clips have position locking tabs that, when deployed, fix the clips at a selected location on the header bar without the need for separate fasteners.

Multiple panels in spaced relation to one another can be assembled on a single header bar. A snap-in trim piece is provided to afford a finished appearance on a lower face of the header bar at any gaps between acoustical panels on a common header bar.

BRIEF DESCRIPTION OF THE DRAWINGS

FIG. 1 illustrates an example of an acoustical baffle system of the invention;

FIG. 2 is a fragmentary cross-sectional view of the baffle system taken in the plane 2-2 indicated in FIG. 1;

FIG. 10 is a perspective view of a header bar end cap; and

FIG. 11 is a perspective view of a length of a trim closure.

DESCRIPTION OF THE PREFERRED EMBODIMENT

An acoustical baffle assembly or system 10 includes a header bar 11 which supports and serves as a trim cap for an acoustical panel 12. The panel 12 is a flat, board-like unit that is preferably high porous and sufficiently rigid to maintain its shape when suspended in a manner described below. Preferably, the panel 12 has a fiber and binder core made with processes and compositions used in the suspended ceiling tile industry. The exterior of the panel core may be clad with an acoustical fabric, woven or non-woven, or may be finished with a non-blocking acoustical coating, known in the ceiling tile industry. Ideally, the panel 12, owing to the porosity of its core and limited acoustical blocking of any covering, is highly sound absorptive. The panel 12, by way of example, can have a nominal thickness of 1 inch and face dimensions of 2 foot by up to 8 foot.

Figure 3:
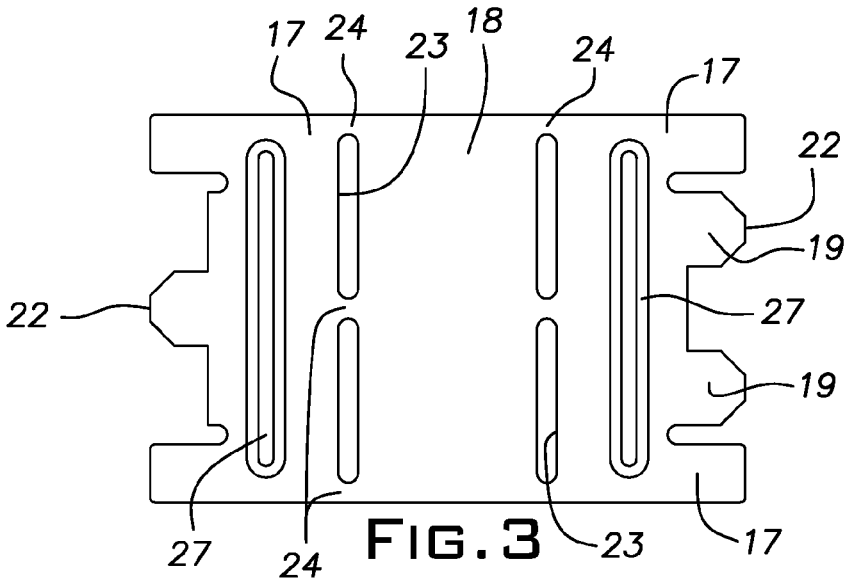
FIG. 3 is a plan view of a blank used for forming a retention clip of the invention.
Figure 4:
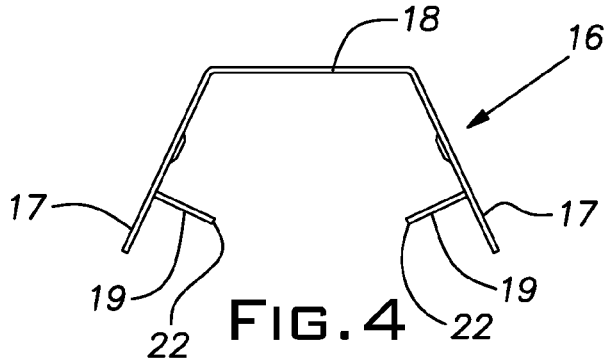
FIG. 4 is an end view of the retention clip as manufactured.
Figure 5:
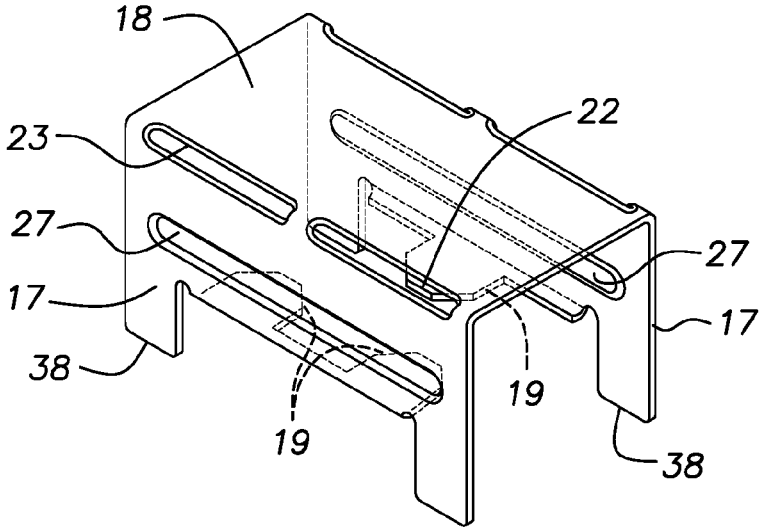
FIG. 5 is a perspective view of the retention clip bent into a deployed panel gripping configuration.

A panel retention clip 16, illustrated in FIGS. 3-5 is a sheet metal stamping of 22 gauge hot dipped galvanized (HDG) steel, for example. The clip 16 is manufactured in an open or obtuse U-shape, shown in FIG. 4, with opposed sides 17 and a web 18 between the sides. The clip sides 17 include piercing tabs 19 perpendicular to a respective side. The tabs 19 are staggered from side-to-side in a lengthwise direction of the clip 16 so that the tab of one side projects along a line intervening lines along which the tabs of the other side project. Free ends 22 of the tabs 19 are spaced in the manufactured configuration (FIG. 4) from side-to-side a distance large enough to accept the thickness of a panel 12 therebetween, preferably with a degree of clearance.

Elongated slots 23 in the clip 16 assure that the clip sides 17 will fold at remaining land areas 24 that serve as hinge lines during installation of the clip 16 on the panel 12. Embossed areas 27 rigidify each clip side 17.

The tabs 19 penetrate the panel 12 thereby clinching and locking the clip 16 to the panel. The path of the tabs 19 as they swing about the hinge lines formed by the slots 23 enables the tabs to gather and compress local areas of the panel to secure a firm grip of the clip on the panel.

FIG. 2 illustrates the cross-section of the header bar 11. The header bar is preferably an aluminum extrusion of uniform wall thickness. The cross-section is generally an H-shape with opposed legs 31 and an intermediate web 32. Small channels 33 are provided at the top and bottom of inside faces of the legs 31. Interior ribs 34 on the legs cooperate with the web 32 to form associated slots or tracks 36. The header bar 11 can be painted flat white, for example, or another color or left natural.

As shown in FIG. 2, the profile of the clip 16, when clinched on the panel 12, is proportioned to fit in the header bar space below the web 32. Lower edges 38 of the clip sides 17 can be located in the channels 33 on the lower side of the header bar 11. The height of the clip sides 17 is greater than a distance from the underside of the header bar web 32 to a top of the flanges, designated 39, forming the channels 33 so that the web 32 retains the lower edges 38 in the channels.

With a plurality of clips 16 clinched on an upper edge of the panel 12, at 18 inch centers, for example, the edge and clips are assembled into the lower side of the header bar 11, as shown in FIG. 2. The length of a panel 12 can be equal to that of the header bar 11.

Alternatively, a panel 12 can be shorter than the header bar and two or more panels can be assembled on a single header bar. Where a space is desired between panels 12, a length of the extruded strip 41 shown in FIG. 11, can be cut to fill in the open lower face of the header bar. The profile of the strip 41 preferably includes a pair of ribs 42 configured to provide a friction fit in the space between the lower edges of the header bar sides or legs 31. The extruded strip 41 can be finished to match the appearance of the header bar 11.

Figure 6:
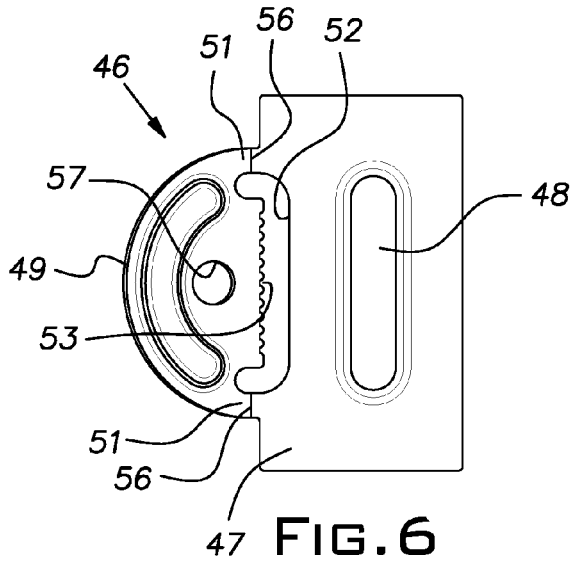
FIG. 6 is a plan view of a hanger clip in an as manufactured configuration.
Figure 8:
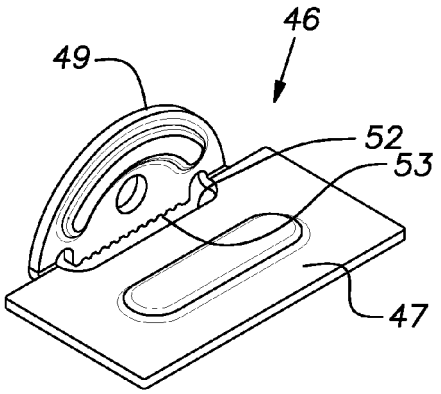
FIG. 8 is a perspective view of the hanger clip in a deployed configuration.
Figure 7:
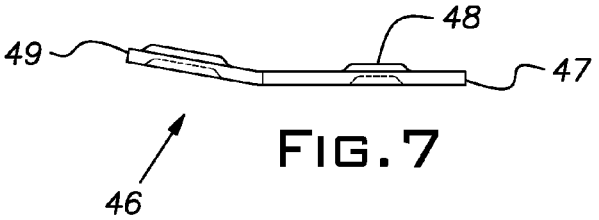
FIG. 7 is a side view of the clip of FIG. 6.
Figure 9:
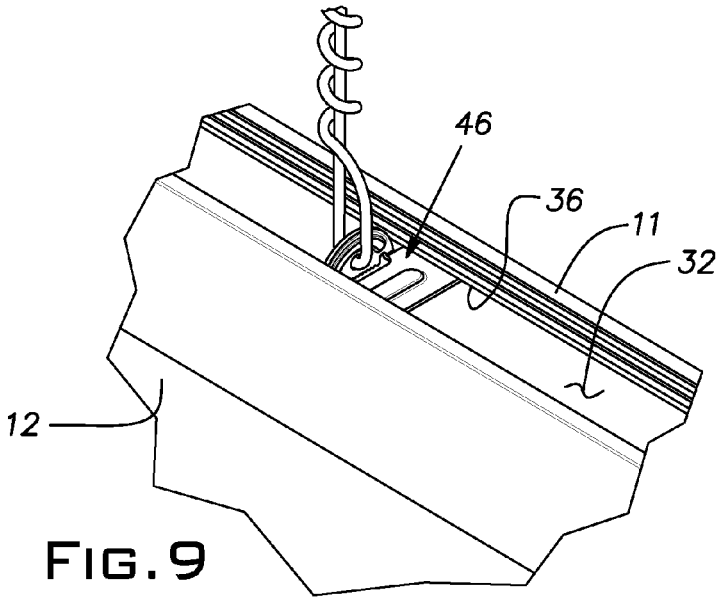
FIG. 9 is a fragmentary perspective view of the hanger clip installed on a header bar of the acoustical baffle system.

Hanger clips 46 are provided for suspending the assembly 10 from an overhead support. The hanger clip 46, shown in FIGS. 6-8, is preferably a sheet metal stamping of, for example, 18 gauge HDG steel. The clip 46 has a rectangular section 47 with a planar margin and a central raised stiffening embossment 48. An arcuate tab 49 is joined to the rectangular section 47 by a pair of straps 51 interrupted by a slot 52. As manufactured, the tab 49 is bent slightly upwardly, e.g. 10 degrees, from the plane of the rectangular section 47 in order to provide a finger grip when the clip is installed on a header bar. An interior edge of the tab 49 comprising a side of the slot 52 is formed with small teeth 53. The tab 49 is stiffened by an upward embossment 54. The straps 51 serve as hinges along a line 56 when the tab 49 is bent upwardly to a position perpendicular to the plane of the rectangular section 47. The extremities of the tab teeth 53 are offset from the line 56 a distance greater than the thickness of the clip 46. A hole 57 through the tab 49 accepts a suspension wire or cable.

Two or more of the hanger clips 46 are assembled on the header bar 11 by sliding the rectangular section 47 endwise into the tracks 36 immediately above the web 32 while the clips have the configuration of FIG. 7. The clips 46 are positioned along the header bar to locations that will underlie overhead suspension points. When properly located, the clip 46 is locked in position along the header bar 11 by forcibly rotating the tab 49 upright. This motion rotates the teeth 53 about the hinge line 56 to a position where they tightly engage and lock onto the upper surface of the web 32 thereby fixing the clip relative to the header bar.

An end cap 61, cast or otherwise formed of aluminum or other suitable material, is illustrated in FIG. 10. The end cap has a vertical plane 62 with a profile matching the outer dimensions of the header bar 11. A tab 63 integral with the plate 62 is configured to be received in the tracks 36 of the header bar so that the perimeter of the plate 62 aligns to the perimeter of the header plate cross-section. The end cap 61 can be fixed in place on the end of a header bar with a screw or screws driven through holes 64 into the header bar web 32.

Ordinarily, a plurality of baffle assembles 10 will be installed in an enclosed space. Typically, the panel assembles will be arranged in a parallel array, spaced from one another, and be at the same elevation. The number of baffle assembles will depend, for example, on the sound levels requiring absorption.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An acoustical baffle assembly comprising an elongated rigid upper carrier, a rigid panel carried on the carrier by a plurality of spaced clips attaching the panel on the carrier at a plurality of locations spaced along a length of the carrier, the clips each being clinched on an upper edge of the panel and being engaged with the carrier, said clips including bars penetrating opposed surfaces of the panel and thereby gripping the panel along said upper edge of the panel, said carrier has a longitudinal slot open at a lower side thereof, the clips and upper edge of the panel being received in said slot, and said slot has a transverse width greater than a width of a slot opening at the lower side of the carrier, the clips being insertable in said slot from an end of the carrier and being larger in width than said slot opening whereby the clips are vertically retained in the slot.

2. The acoustical baffle assembly as set forth in claim 1, wherein the carrier includes said slot in which said clips are slidably received along the length of the carrier.

3. The acoustical baffle assembly as set forth in claim 1, wherein the carrier includes a longitudinal track at an upper side, and a plurality of hanger clips received in said track.

4. The acoustical baffle assembly as set forth in claim 3, wherein said carrier is an extrusion have an H-shaped cross-section, said slot existing below a horizontal web of the extrusion receiving said clips and the track existing above said web.

5. The acoustical baffle assembly as set forth in claim 3, wherein said hanger clips include a bendable tab that when bent grips the carrier to maintain the hanger clip at a selected location in the track.

6. The acoustical baffle assembly as set forth in claim 5, wherein said hanger clips have a portion for receiving a suspension wire for supporting the baffle assembly from such wire.

* * * * *